United States Patent [19]

Dosch et al.

[11] Patent Number: 4,511,455

[45] Date of Patent: Apr. 16, 1985

[54] CATALYSIS USING HYDROUS METAL OXIDE ION EXCHANGES

[75] Inventors: Robert G. Dosch; Howard P. Stephens; Frances V. Stohl, all of Albuquerque, N. Mex.

[73] Assignee: The United States of America as represented by the United States Department of Energy, Washington, D.C.

[21] Appl. No.: 597,590

[22] Filed: Apr. 10, 1984

Related U.S. Application Data

[62] Division of Ser. No. 515,844, Jul. 21, 1983, abandoned.

[51] Int. Cl.[3] ..... C10G 1/06; C10G 47/02; C10G 45/00; C10G 23/00

[52] U.S. Cl. ..... 208/10; 208/112; 208/143; 423/593; 423/598; 501/134

[58] Field of Search ..... 208/10, 112, 143; 501/134; 423/593, 598

[56] References Cited

U.S. PATENT DOCUMENTS

| | | | |
|---|---|---|---|
| 3,331,879 | 7/1967 | Leston | 260/624 |
| 3,736,267 | 5/1973 | Bart et al. | 502/439 X |
| 3,737,491 | 6/1973 | Stander et al. | 502/439 X |
| 3,737,492 | 6/1973 | Stander et al. | 502/439 X |
| 3,776,858 | 12/1973 | Heide et al. | 252/431 R |
| 3,873,469 | 3/1975 | Foster | 252/463 |
| 3,948,807 | 4/1976 | Fuchigami et al. | 252/456 |
| 3,962,189 | 6/1976 | Russin et al. | 502/171 X |
| 4,043,941 | 8/1977 | White et al. | 502/171 |
| 4,055,513 | 10/1977 | Wheelock | 252/462 |
| 4,061,596 | 12/1977 | Matsushita et al. | 252/463 |
| 4,113,658 | 9/1978 | Geus | 252/454 |
| 4,149,961 | 4/1979 | Antos | 208/139 |
| 4,151,123 | 4/1979 | McCann | 252/462 |
| 4,233,139 | 11/1980 | Murrell et al. | 208/112 |
| 4,244,809 | 1/1981 | Wheelock | 208/108 |
| 4,257,922 | 3/1981 | Kim et al. | 252/465 |
| 4,263,133 | 4/1981 | Drehman et al. | 208/134 |
| 4,293,449 | 10/1981 | Herrington et al. | 252/465 |
| 4,306,965 | 12/1981 | Hensley, Jr. et al. | 208/216 PP |
| 4,313,017 | 6/1982 | McGinnis et al. | 585/266 |
| 4,313,820 | 2/1982 | Farha, Jr. et al. | 208/213 |
| 4,374,753 | 2/1983 | Pullukot et al. | 252/429 B |

OTHER PUBLICATIONS

The Use of Titanates in Decontamination of Defense Waste, R. G. Dosch, Jun. 1978, SAND-78-0710, Sandia Lab., Albuquerque, N.M. 87185.

Final Report on the Appl. of Titanates, Niobates and Tantalates to Neutralized Defense Waste Decontamination . . . , Sandia Lab., Albuquerque, N.M., Dosch, Jan. 1981.

Strong Interactions in Supported-Metal Catalysts, Tauster et al., Mar. 13, 1981, vol. 211, No. 4487, Science pp. 1121-1125.

*Primary Examiner*—William G. Wright

*Attorney, Agent, or Firm*—Armand McMillan; Albert Sopp; Judson R. Hightower

[57] ABSTRACT

In a process which is catalyzed by a catalyst comprising an active metal on a carrier, said metal being active as a catalyst for the process, an improvement is provided wherein the catalyst is a hydrous, alkali metal or alkaline earth metal titanate, zirconate, niobate or tantalate wherein alkali or alkaline earth metal cations have been exchanged with a catalytically effective amount of cations of said metal.

12 Claims, No Drawings

CATALYSIS USING HYDROUS METAL OXIDE ION EXCHANGES

The United States Government has rights in this invention pursuant to Contract No. DE-AC04-76DP00789 between the United States Department of Energy and Western Electric Company.

This is a division of application Ser. No. 515,844 filed Jul. 21, 1983 now abandoned.

BACKGROUND OF THE INVENTION

This invention relates to improved processes, e.g, the cracking of hydrocarbons, using a new catalyst system. Interest in efficient liquefaction of coal to liquid fuels and, generally, cracking of hydrocarbons such as tars and heavy oils to form efficient fuels, has encouraged exploration of new and promising catalytic systems for these and other reactions.

Many such catalytic systems have been identified in the past. For example, the following United States Patents disclose the use of many metallic catalysts, usually adsorbed onto catalytic supports, which can be used to catalyze cracking and related reactions. Such catalysts include various metals supported on titanates, e.g., zinc titanates. These patents include. U.S. Pat. Nos. 4,318,820; 4,313,017; 4,306,965; 4,263,133; 4,257,922; 4,244,809; 4,233,139; 4,151,123; 4,149,961; and 4,055,513.

Other United States Patents disclose various methods for impregnating titanium dioxide based supports with catalytic metals for use in a variety of reactions, including cracking reactions. In general, all of these prior art methods involve adsorption onto the conventional titanate substrate. For instance, U.S. Pat. No. 4,293,449 discloses the preparation of a catalyst by coating commercial supports with hydrated oxides such as $Al_2O_3.(H_2O)_2$ and $Na_2SiO_3.(H_2O)_2$ or hydrated titanate or zirconate salts (see Column 3, lines 39–44, of the reference) then calcining the coatings to form a high surface area material. This is followed by wetting of the support with solutions of salts of active metals and then drying of the catalyst. Reactive metals are impregnated into the catalyst by physical adsorption. U.S. Pat. No. 3,873,469 describes the preparation of a catalyst by wetting of a commercial support, including titania, zirconia, etc., with a metal alkoxide followed by hydrolysis and calcination to form an oxide coating. The active catalyst is prepared by wetting the surface of the support with a solution of active metal ions. Again, the metal ions are included in the catalyst by physical adsorption. U.S. Pat. No. 4,061,596 describes the preparation of a titanium oxide catalyst substrate. Among other methods, the latter is prepared by hydrolyzing titanium alkoxide to the corresponding hydroxide which is then calcined to form the oxide. Again, active metal ions are incorporated into the catalyst by physical adsorption methods. Other related processes are disclosed in U.S. Pat. Nos. 4,113,658 and 3,948,807.

A certain class of hydrous oxide ion exchange compounds have previously been investigated at Sandia National Laboratories for use in decontamination of aqueous nuclear waste (R. G. Dosch, "The Use of Titanates in Decontamination of Defense Waste", SAND-78-0710, Sandia National Laboratories, Albuquerque, NM, June 1978; R. G. Dosch, "Final Report on the Application of Titanates, Niobates, and Tantalates to Neutralized Defense Waste Decontamination—Materials Properties, Physical Forms, and Regeneration Techniques", SAND-80-1212, Sandia National Laboratories, Albuquerque, NM, January 1981) and as precursors for ceramic materials (D. L. Hankey et al, "Preliminary Investigations on Microstructure Development in PZT Ceramics", Abstract, 34th Pacific Coast Regional Meeting of American Ceramic Society, October 1981). Unlike the prior art catalytic supports, metal ions incorporated into these materials are contained therein not by physical adsorption but rather by ion exchange. Hence, although various properties of the known hydrous oxide ion exchangers might have suggested a potential for use as catalytic material, it could not be predicted or expected that such materials would in fact exhibit catalytic, hydrogenation or other related activity at least because of the presence of the metal ions via an ion exchange mechanism.

SUMMARY OF THE INVENTION

It is an object of this invention to provide a new use for known hydrous metal oxide ion exchanger materials.

It is a further object of this invention to provide a new catalyst system for active metals in a wide variety of reactions.

It is another object of this invention to provide a method for cracking hydrocarbon materials using new catalysts.

Upon further study of the specification and appended claims, further objects and advantages of this invention will become apparent to those skilled in the art.

These objects have been attained by providing in a process which is catalyzed by a catalyst comprising an active metal on a carrier, said metal being active as a catalyst for the process, the improvement wherein the catalyst is a hydrous, alkali metal or alkaline earth metal titanate, zirconate, niobate or tantalate wherein alkali or alkaline earth metal cations have been exchanged with a catalytically effective amount of cations of said active metal.

In a preferred embodiment, the process is the hydrotreating of hydrocarbons, e.g., liquefaction of coal.

DETAILED DISCUSSION

A number of properties of the catalysts used in this invention make them highly satisfactory as substrates for active metals as defined for this invention. For example, any active metal or mixture of metals can be atomically dispersed in the substrates of this invention over a wide concentration range using the simple method of this invention (e.g., multifunction catalysts can be prepared). In addition, the substrate materials have a wide range of high surface areas, exhibit good chemical stability, (e.g., long lifetimes even in high temperature processes) and have other highly desirable surface properties described herein. Furthermore, conventional solution chemistry or high temperature reactions can be used to provide control of the active metal oxidation state. Furthermore, if necessary, the acidity and basicity of the substrate can be modified by conventional ion exchange. In addition, the substrates belong to a recently discovered class of supports exhibiting strong interactions with the metal catalysts supported thereon e.g., upon calcination in hydrogen, and consequently may have very high activities (Tauster et al, *Science* 211, 1121 (1981)). Further advantageously, they can be prepared in a wide variety of geometric forms, including spheres.

The preparation of the catalysts of this invention is thoroughly described in the mentioned references incorporated by reference herein.

One method can be summarized as follows:

(1) Reaction of a $C_{2-5}$-alkoxide of Ti, Zr, Nb or Ta with an alkali or alkaline earth metal hydroxide (e.g., Na, K, Ba, Sr, etc.) in alcohol solution to form a soluble intermediate, for example, for titanium:

$$Ti(OC_3H_7)_4 + NaOH \xrightarrow{CH_3OH} \text{Soluble Intermediate}$$

(2) Hydrolysis of the soluble intermediate, e.g., in acetone/water mixtures to form the hydrous metal oxide ion exchange material.

$$\text{Soluble Intermediate} \xrightarrow{\text{Acetone, } H_2O} [NaTi_2O_5H]_x$$

wherein x will depend on the particular composition, solvent, etc. and usually is up to 100, 200 etc.

(3) Ion exchange of the alkali or alkaline earth metal for active metal ions in aqueous solution to form the catalyst:

$$2[NaTi_2O_5]_x + XNi^{+2}(aq) \rightarrow 2XNA^{+} + [Ni(Ti_2O_5H)_2]_x$$

The first step involving the reaction of the alkoxide with a base is generally carried out in alcohol solution. Typical alcohols include the lower alkanols such as methanol, ethanol, isopropanol etc. It is necessary that the hydroxide which is used in preparing the initial material (reaction 1) be soluble in the alcohol solvent. Accordingly, the mentioned alkali or alkaline earth metal hydroxides are employed. If desire a alkaline earths with relatively alcohol insoluble hydroxides can be substituted by ion exchange. These reactions go to completion essentially instantaneously e.g., on the order of minutes and, thus, can conveniently be carried out at room temperature. However, of course, temperatures up to the boiling point of the reaction medium can be used. In general, the mole ratio of hydroxide to titanium can vary up to a value of about 2. All starting materials are commercially available. The structure of the soluble intermediate has not yet been elucidated. The hydrous oxides, as prepared, are X-ray amorphous.

The hydrolysis step (2) is generally carried out by pouring the reaction medium which results from the first reaction directly into the hydrolysis medium, e.g., water or a mixture of acetone and water, preferably a mixture of 10% water and 90% acetone which gives a product of particularly good agglomeration and, hence, filterability properties. However, in general, a very broad range of ratios of water to acetone will be suitable. Again, the reaction is essentially instantaneous and is completed on the order of minutes at room temperature. The degree of hydrolysis of the soluble intermediate is usually always complete. Even when complete hydrolysis is not effected in the reaction per se, exposure to atmospheric moisture will complete the hydrolysis.

The third step involves the loading of the hydrous ion exchange material with the desired active metal. For this purpose, the hydrous product of the previous step is usually dried at ambient temperature in vacuuo. The degree of vacuum is not critical but will be chosen to afford a satisfactory drying time. Drying at higher temperatures is disadvantageous since both the surface area and the ion exchange capacity decrease essentially linearly as the drying temperature increases in the range of room temperature to about 500° C.. The metal loading step is carried out very easily by simply treating the dried hydrous support material with an aqueous solution of an active metal salt or a mixture thereof. Active metal complexes can also be used as long as the tenacity of binding of the metal cation to the ligands is less than its affinity for the ion exchange material.

The amount of active metal loaded onto the support material can be very easily controlled. Final values will be selected routinely in accordance with the details of the reaction of interest. For example, the degree of loading can be limited by limiting the amount of alkali metal or alkaline earth metal in the support material by appropriately limiting the amount of alkali metal or alkaline earth metal hydroxide used in the first step of the preparation. Alternatively, by appropriately controlling the amount of active metal cations in the aqueous solution used to treat the support in the loading step, a selected proportion of alkali metal or alkaline earth metal cations in the support can be exchanged. Generally, 100% exchange will be effected and the amount of active metal in a catalyst will be in the range of 0.1–20 wt % (depending on the atomic weight of the cation), based upon the total weight of the catalyst.

The active metals to be exchanged with the support material are not limited. Basically, any cation can be exchanged onto the support material. Selection of the active metal or mixture of active metals will be made routinely by those of skill in the art, perhaps with a few routine preliminary experiments, in conjunction with conventional considerations pertaining to the reaction of interest. Typical active metals are well described in the literature, e.g., in the patents disclosed above, the disclosures of which are incorporated by reference herein in this regard.

The formula given in the reaction for preparation step (3) discussed above is representative only. It is not intended to limit the scope of this invention in any way. In general, the pore volumes of the catalysts used in this invention will be in the range of about 0.2–0.4 cc/g. However, higher or lower values can be achieved if desired. Typical specific surface areas will be in the range of about 150 to greater than 300 $m^2/g$. Again, lower or higher values can be achieved if desired. Typical exchange capacities can be varied over a large range in dependence upon the amount of alkali metal or alkali earth metal which is reacted in the first step of the preparation described above. Generally, exchange capacities will be in the range of a few milliequivalents per gram. Again, actual values can vary significantly depending upon the end use. For all of these and, as well, other properties of the catalysts optimum values in a given reaction can be readily determined with a few routine preliminary experiments.

Generally, the catalyst is used as obtained from the active metal loading step after a room temperature vacuum drying as described above. Calcination post treatments at temperatures up to 450° C. have been shown not to affect the catalytic properties significantly.

The catalysts of this invention can be used in essentially all prior art reactions which can employ catalytic metals on titania carriers. Such processes are extremely diverse and include, e.g., reforming reactions, oxidation reactions, dehydrations, Fischer Tropsch reactions, reductions, etc. Particularly preferred reactions of this invention are the hydrocarbon hydrotreatment processes, e.g., tar, heavy oil, etc. cracking, coal liquefaction, etc. The products of such reactions are well known to those skilled in the art as are the appropriate reaction conditions. All of these details are fully applicable to this invention; that is, in general, the hydrotreating or other process of this invention will be fully conventional in all aspects except for the use of the catalyst required by this invention. In this regard, see all of the references mentioned above. These disclosures are entirely incorporated by reference herein. The hydrotreating process of this invention is highly advantageous in that it maximizes the rate and amount of conversion to products while minimizing the amount of hydroqen needed. Furthermore, since the active metals will often be costly or strategic materials, the significantly lessened amount of the same exhausted by this invention, e.g., due to higher activity, longer lifetime, recyclability, etc., is an important advantage.

The shape of the catalyst will not be critical, pellets, spheres, powders, etc. all being employable. Typical particle sizes are in the submicron range, e.g., as small as about 50Å. This high fineness is a unique aspect of the catalysts of this invention. Fixed bed or fluidized bed reactions can be used. The catalysts can be formulated as extrudates, with binders or in any other preferred conventional form.

The catalysts of this invention as prepared in accordance with the above will contain volatiles. Approximately 90% of the volatiles will generally be removed at about 200° C. and greater than about 95% will be removed after heating at 400° C. Furthermore, X-ray diffraction and SEM experiments have indicated that a transition from an amorphous to crystalline forms, e.g., anatase and rutile in the titanate case, will occur at higher temperatures, i.e., at approximately 600° C. for the titanate case. This has been supported by DTA and TGA studies, which showed a large exotherm with no corresponding weight change at the same temperature. The catalyst is employable in the process of this invention in all of these forms, amorphous, with or without volatiles and even in crystalline form although amorphous catalysts are greatly preferred.

Using the catalyst preparation process of this invention, by appropriately controlling the amount of active metal in the aqueous loading solution, the amount of active metal on the support can be varied from a thin surface film to a thorough impregnation via ion exchange, i.e., complete conversion of the alkali and alkaline earth metal cations. Generally, complete conversion will be used in the preparation of the catalysts.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever. In the following examples, all temperatures are set forth uncorrected in degrees Celsius; unless otherwise indicated, all parts and percentages are by weight.

EXAMPLE 1

The titanate system has been the best characterized one and is the least expensive of the hydrous oxides as prepared by these techniques. Titanate catalysts were prepared by exchanging the sodium ions of a hydrous oxide titanium compound, generically called sodium titanate (ST), with the desired metal ions in aqueous solution. ST was prepared by reacting commercially available tetraisopropyl titanate with sodium hydroxide in methanol, hydrolyzing the solution in a water/acetone mixture and drying the resulting precipitate at ambient temperature under vacuum. The preparation steps may be illustrated as follows:

$$Ti(OC_3H_7)_4 + NaOH \xrightarrow{CH_3OH} \text{Soluble Intermediate} \quad (1)$$

$$\text{Soluble intermediate} \xrightarrow{\text{acetone}/H_2O} [NaTi_2O_5H]_x \quad (2)$$

$$2[NaTi_2O_5H]_x + XNi(aq) \rightarrow 2XNa + [Ni(Ti_2O_5H)_2]_x \quad (3)$$

A typical product was a fluffy powder with a surface area in the range of 150–300 $m^2/g$ which contains approximately 20% residual volatile constituents, i.e., water and alcohols. Subsequent contact with water produced a hydrolysis reaction in which sodium ions in ST were replaced by hydrogen ions resulting in increased solution pH. If the water contained dissolved polyvalent metal ions, they were fixed on the titanate matrix either by exchange with sodium ions or by hydrolysis reactions due to localized high pH within the ST particles or a combination of the above reactions. Subseqent drying at ambient temperature under vacuum produced the same morphology and volatile content found in the original ST material.

Further drying at elevated temperature resulted in loss of volatiles and decreased surface area. Approximately 90% of the volatiles were removed at 200° C. and greater than 95% were gone after calcining at 400° C. Surface area decrease was nearly linear with temperature in the range of 25°–600° C. Both the as-prepared ST and exchanged ST were amorphous. XRD and SEM work indicated that a transition from an amorphous to a crystalline form occurred at approximately 600° C. This is supported by DTA and TGA results, which show a large exotherm with no corresponding weight change at the same temperature.

With respect to catalyst preparations, ST could be loaded with any metal or combination thereof e.g., in the range of about 0–20% by weight using a very simple technique which provided atomic scale distribution of the metal on the substrate. The materials were amorphous, hydrated oxides which could be converted to crystalline form by heating. Non-powder forms of ST which can be prepared included cylindrical pellets and small spheres. Using the same loading techniques, metal ion distributions ranging from thin surface films to complete conversion could be achieved. Water soluble quaternary ammonium (QA) forms of the titanate (e.g., prepared by reacting the alkoxides with, for example, tetramethylammonium hydroxide, which form is water soluble in contrast to ST) can be used for in situ formation of a titanate-supported metal catalyst on nearly any surface. The surface to be coated is wet with a dilute solution of the QA titanate and dried leaving a thin film of the compound. Subsequent contact with an aqueous solution containing dissolved metal salts results in metal ion - QA ion exchange forming a water insoluble hydrated metal titanate on the surface.

For subsequent tests using hydrated metal titanates as catalysts for coal liquefaction, ST powder was used to prepare samples loaded with $Cr^{+3}$, $Fe^{+2}$, $Fe^{+3}$, $Ni^{+2}$, $Pd^{+2}$, Mo*, $Rh^{+3}$, $Ru^{+3}$, $Co^{+2}$, $Mn^{++}$, $Eu^{+3}$, and a mixture of $Co^{+2}$ and Mo*. The foregoing methods were utilized. All materials were dried at ambient temperature under vacuum prior to testing.

*See table A

EXAMPLE 2

Preparation of Hydrous Titanate Catalysts

Hydrous titanate catalysts were prepared by a two-step process which consisted of the synthesis of the sodium hydrous titanate ion exchange material followed by exchange of the sodium for active metal ions. The following description illustrates the preparation of sodium hydrous titanate and the hydrous titanate catalyst loaded with 10 wt % (volatile free basis) nickel, molybdenum or palladium. All of the catalysts used in the example were prepared fully analogously.

Sodium Hydrous Titanate 569.2 grams of tetraisopropyl titanate $Ti(OC_3H_7)_4$ was slowly added with continuous stirring (exothermic reaction) to 266.7 grams of a 15 wt % solution of sodium hydroxide in methanol. The resulting solution was hydrolyzed by rapid addition to a solution of 200 ml of water and 2 l of acetone. After the slurry was homogenized by stirring, it was filtered with a coarse glass frit. The precipitate was collected and dried overnight under vacuum at ambient temperature. Recovery of the titanium and sodium was quantitative and the product represented by the empirical formula $NaTi_2O_5H$ contained 20 to 30 wt % of volatile constituents, predominantly water with minor amounts of alcohols. The ion exchange capacity of the sodium hydrous titanate was typically 4 milliequivalents per gram.

Nickel, Molybdenum and Palladium Hydrous Titanate Catalysts Nickel

A one normal solution of nickle nitrate.$6H_2O$ was prepared. Its pH was adjusted to 6, and 215 ml of this solution were diluted with water to 700 ml. 80 g of sodium hydrous titanate powder was added to this nickel solution. After the slurry was homogenized by stirring, it was filtered and washed with water followed by acetone to remove traces of sodium nitrate. The nickel exchange catalyst was dried overnight in vacuum at ambient temperature. Analysis of the vacuum dried catalyst showed nickel, sodium and volatile contents of 7.70%, 2.73%, and 26.02% respectively or 10.4% nickel and 3.68% sodium on a volatile free basis.

Molybdenum 7 grams of molybdenum metal was dissolved in 50 ml of a 1 to 1 mixture by volume of concentrated nitric and hydrochloric acids. After diluting the molybdenum solution to 800 ml in water and adjusting the pH to 2 with sodium hydroxide, it was filtered through a coarse glass frit and diluted further to 1.0 liter with water. 75 grams of sodium hydrous titanate powder was added to 866 ml of the Mo solution. The pH of the supernate was adjusted to 4 to allow exchange of 99.8% of the Mo in the solution. The Mo exchanged catalyst was filtered, washed and dried by the same procedure used for preparation of the nickel catalyst. The vacuum dried catalyst contained 8.18% Mo, 0.5% Na, and 23.01% volatiles or 10.6% Mo and 0.65% Na on a volatile free basis.

Palladium 6.32 grams of palladium metal was dissolved in a solution prepared from 17 ml of concentrated nitric and 0.2 ml of concentrated hydrochloric acid. The resulting palladium solution was diluted to 700 ml with water. 80 grams of sodium hydrous titanate was added to this solution. The slurry was filtered washed and dried by the procedure used for the nickel preparation. The vacuum dried material contains 7.62% palladium, 2.65% sodium and 26.78% volatiles or 10.41% palladium and 3.62% sodium on a volatile free basis.

EXAMPLE 3

Preliminary characterization of loaded materials prepared in Examples 1 and 2 consisted of elemental analysis to determine the exchanged metal loading, surface area and pore volume distributions. For these exploratory preparations, metal loadings of 1 to 19% were achieved.

The surface areas were determined by BET techniques with nitrogen and the pore volume distributions were determined by adsorption-desorption studies. The results of the characterizations are shown in Table A. The results show that, although the same starting material was used, the surface areas of the exchanged titanates can be a factor of two larger. The cause of this variation is believed due to the different metals present or to different acidity conditions at the times the metals were exchanged. The desorption cumulative pore volumes show a range from 0.24 to 0.41 cc/g, although the pore volume distributions appeared to be similar for all the materials. All of the titanates had bimodal pore volume distributions similar to the distribution for Ni titanate (total pore volume =0.31).

EXAMPLE 4

Exploratory coal liquefaction tests were performed on twelve of the fifteen titanates which were prepared. The liquefaction reactions were all performed in 40 cc microreactors using Illinois #6 Burning Star coal; SRC-II heavy distillate (2:1 solvent:coal), and high purity hydrogen as reactants. Cold charge pressures of 1000 psig, a temperature of 425° C., and reaction times of 30 minutes were used for all experiments. Titanate additions were 5% by weight on a coal basis. The product analyses were determined by a combination of gas and liquid chromatographic, and tetrahydrofuran (THF) solubility techniques. See, T. C. Bickel et al, "Coal Liquefaction Process Research Semi-Annual Report for October 1980 - March 1981, SAND-81-1569. December 1981, and H. P. Stephens, "Product Yield and Hydrogen Consumption Selectivity Tests for Coal Liquefaction Catalyst Development", Preprints, ACS Fuel Division 26, 161, Aug. 23,1981.

TABLE A

| SAMPLE | METAL LOADING (WT %) | S.A. ($m^2/g$) | CUMULATIVE PORE VOL (cc/g) ADS | DES |
|---|---|---|---|---|
| Na Titanate (ST) | 10 | 153 | 0.24 | 0.33 |
| $Ru^{+3}$ | <1 | 143 | 0.21 | 0.25 |
| $Rh^{+3}$ | 12 | 160 | 0.20 | 0.24 |
| $Cr^{+3}$ | 5 | 170 | 0.26 | 0.30 |
| $Fe^{+3}$ | 5 | 214 | 0.30 | 0.34 |
| $Ni^{+2}$ | 12 | 219 | 0.26 | 0.31 |
| $Fe^{+2}$ | 8 | 219 | 0.29 | 0.35 |
| $Co^{+2}$ | 9 | 226 | 0.27 | 0.31 |
| $Pd^{+2}$ | 5 | 227 | 0.21 | 0.25 |

TABLE A-continued

| SAMPLE | METAL LOADING (WT %) | S.A. ($m^2/g$) | CUMULATIVE PORE VOL (cc/g) ADS | DES |
|---|---|---|---|---|
| $H^+$ | 2 | 245 | 0.35 | 0.41 |
| $Eu^{+3}$ | 19 | 257 | 0.22 | 0.25 |
| $Mn^{+2}$ | 10 | 269 | 0.22 | 0.26 |
| $Co^{+2}$/Mo* #1 | 3/3 | 274 | 0.24 | 0.28 |
| $Co^{+2}$/Mo* #2 | 8/6 | 293 | 0.30 | 0.34 |
| Mo* | 3 | 296 | 0.25 | 0.28 |

*Oxidation state is unknown.

From the amount of conversion to THF soluble products (Table B) the titanates tested could be divided into two groups—(1) those (Rh, Ni, Co, Mo, Pd, Ru, Co/Mo) which showed substantial catalytic activity (i.e., produced a significantly greater yield of THF soluble products than the control experiment with no titanate addition) and (2) those (Cr,Mn, Na, Fe, Eu) which had little or no catalytic activity (i.e., produced about the same THF conversion as the control). From these results, it can be seen that the experiments with the catalytically active titanates produced 15 to 23% higher THF conversions than the control sample

EXAMPLE 5

Liquefaction reactions were again performed with Illinois No. 6 (Burning Star) coal, SRC-II heavy distillate solvent from the Ft. Lewis Pilot Plant (1:2 coal:solvent, by weight) and high purity hydrogen. Shell 324 M, a 2.7% Ni/13.2% Mo on alumina catalyst, currently used in integrate two stage liquefaction pilot plant studies (Schindler et al, Proceedings of the Seventh Annual EPRI Contractor's Conference, Palo Alto, CA, May 1982), was ground to −200 mesh and used as a reference for comparison of catalytic activity. Control experiments were also performed without catalyst addition.

As a result of the screening liquefaction experiments of Example 4 and others, three titanates were chosen to test the effects of active metal, metal loading and post-preparation treatment on catalytic activity.

A randomized factorial experimental plan (3×2 with duplication) was used to test the effect of active metal and metal loading on liquefaction activity. For these experiments, Ni, Mo and Pd titanates with metal loadings of 1% and 10%, by weight of titanate, were used. Catalyst weight added to the reactor was adjusted so that liquefaction reactions with the 1% titanates were performed with $4\times10^{-5}$ moles of active metal and reactions with the 10% titanates with $4\times10^{-4}$ moles. To test the effects of catayst post-preparation treatments, which result in loss of volatiles and surface area, and oxidation or reduction of the Ni, duplicate experiments were performed with the 10% Ni titanate heated for two hours at six conditions—300°, 450° and 700° C. in air and hydrogen. Reference experiments with Shell 324 M were performed with the same number of moles of active metal (Ni+Mo) as the 10% loading experiments.

TABLE B

Results of Exploratory Coal Liquefaction Tests with Titanates. Conversion to Tetrahydrofuran (THF) Soluble Products.

| Titanate | THF Conversion (Wt. % dmmf) |
|---|---|
| $Rh^{+3}$ | 95 |
| $Ni^{+2}$ | 92 |

TABLE B-continued

Results of Exploratory Coal Liquefaction Tests with Titanates. Conversion to Tetrahydrofuran (THF) Soluble Products.

| Titanate | THF Conversion (Wt. % dmmf) |
|---|---|
| $Co^{+2}$ | 88 |
| Mo* | 90 |
| $Pd^{+2}$ | 93 |
| $Ru^{+3}$ | 88 |
| Co/Mo | 87 |
| $Cr^{+3}$ | 71 |
| $Mn^{+2}$ | 68 |
| $Na^+$ (ST) | 77 |
| $Fe^{+3}$ | 77 |
| $Eu^{+3}$ | 77 |
| Control** | 72 |

*Oxidation state unknown
**No titanate addition

All liquefaction reactions were performed in 40 $cm^3$ microreactors which were charged with 2.67 g of coal, 5.33 g SRC-II, and powdered catalyst, pressurized to 800 psig (cold) with hydrogen, then heated to 425° C. for 30 minutes and shaken at ~150 cycles/min. during the heating period. Temperatures and pressures were accurately recorded with a digital data acquisition system during the course of the experiments. Following the heating period of each experiment, the reaction vessel was quenched to ambient temperature, the resulting pressure was recorded, a gas sample was taken, and the product slurry was subsampled for analysis.

Gas samples were analyzed for mole percentages of CO, $CO_2$, $H_2S$ and $C_1$–$C_4$ hydrocarbons with a Hewlett-Packard 5710A gas chromatograph, which was calibrated with standard mixtures (Matheson Gas Products) of hydrocarbon gases in hydrogen. Hydrogen in the samples was obtained by difference as the remainder of the product gas mixture. The quantity of each gas produced was calculated from the mole percent in the gas sample and the post-reaction vessel temperature and pressure using an ideal gas law calculation. Hydrogen consumed during the reaction, obtained as the difference between the inital charge and hydrogen remaining after the reactor was quenched, was reported on a percent dmmf coal basis.

The reaction product slurry was analyzed for insols, high molecular weight (mw) product, intermediate mw product and low mw product by tetrahydrofuran (THF) solubility and high performance liquid chromatography (HPLC). A 0.2 g subsample was mixed with about 50 ml of THF, filtered to obtain the weight of insols, and brought to 100 ml with additional THF. Chromatograms of 5 μl aliquots of the filtrate were obtained with a Waters Assoc. Model 6000A solvent delivery system, a 100 Å microstyragel gel permeation column, and a Model 440 uv absorbance detector. The uv absorbance response factors for the product groups were determined using calibration samples prepared by dissolving known weights of high (~1000 g/mole), intermediate (~500 g/mole) and low (250 g/mole) mw coal-derived products obtained by preparative scale liquid chromatographic (gel permeation) separation of whole liquid product from liquefaction reactions performed under similar conditions with the same coal and solvent. Chromatogram area measurements and response factors were used to calculate the percentages of high, intermediate and low mw products for the THF soluble product. (% conversion to low mw product is approximately equivalent to pentane soluble product.)

Conversion data were calculated on a dmmf coal basis, and included corrections for the conversion of the pyrite content of the coal to pyrrhotite and the loss of volatiles, if any, from the catalyst.

Previous statistical analysis of experiments with oil soluble catalysts (Johnston et al, "Coal Liquefaction Process Research Quarterly Report for Jan. 1—Mar. 31, 1982", SAND-82-1924, Sandia National Laboratories, Albuquerque, NM, October 1982) has shown that hydrogen consumption and conversion to low mw product may be used as quantitative measures of catalyst activity for coal liquefaction. Tables C and D illustrate the conversion to low mw product and hydrogen consumption for the experiment with the 1 and 10% Ni, Mo and Pd titanates without post-preparation treatments. The values represented in the tables are the averages of duplicate experiments. Standard deviations were statistically determined to be 1.4% for conversion to low mw product and 0.13% for hydrogen consumption. As can be seen, the ranking for metals effect with respect to both low mw conversion and hydrogen consumption is Pd>Mo>Ni and with respect to metals loading is 10%>1%.

TABLE C

EFFECT OF ACTIVE METAL AND PERCENT LOADING ON CONVERSION TO LOW MW PRODUCT

| | Conversion (Wt % dmmf) | |
|---|---|---|
| Blank (no catalyst) | 27 | |
| Shell 324 M | 43 | |
| | 1% Loading on Titanate | 10% Loading on Titanate |
| Ni Titanate | 41 | 45 |
| Mo Titanate | 43 | 47 |
| Pd Titanate | 47 | 49 |

TABLE D

EFFECT OF ACTIVE METAL AND PRECENT LOADING ON HYDROGEN CONSUMPTION

| | Hydrogen Consumption (Wt % dmmf Coal Basis) | |
|---|---|---|
| Blank (no catalyst) | 0.7 | |
| Shell 324 M | 1.9 | |
| | 1% Loading on Titanate | 10% Loading on Titanate |
| Ni Titanate | 1.2 | 1.5 |
| Mo Titanate | 1.4 | 1.9 |
| Pd Titanate | 1.7 | 2.1 |

Results of a two-way analysis of variance were used to make a quantitative comparison of performance. The effect of active metals (1 and 10% loadings averaged), were as follows:

low mw product:

Pd (47.7%)>Mo (45.3%)>Ni (43.0%) F=10.8, P<0.01;

hydrogen consumption

Pd (1.86%)>Mo (1.65%)>Ni (1.35%) F×22.4, P<0.005, where F is the variance ratio and P is the probability of a chance occurrence of the result. These values may be compared with the results of experiments without catalyst addition (low mw product =26.8% and hydrogen consumption =0.69%) and experiments with Shell 324 M (low mw product=42.8% and hydrogen consumption=1.88%). It was found that the 10% titanates averaged 3.2% greater conversion (F=10.8, P<0.01) and 0.37% greater hydrogen consumption (F=35.0, P<0.005) than the 1% titanates.

Only one post-preparation treatment of the 10% Ni titanates was found to have a significant effect on catalytic activity. Experiments with the titanate heated to 700° C. in air produced a conversion of 33.6% to low mw product and had a hydrogen consumption of 0.71% which was significantly lower than the values for the other treatments (45.2 ±1% and 1.5±0.2%). X-ray diffraction analysis of the post-preparation treated materials shows formation of $NiTiO_3$ for only the material heated to 700° C. in air. The $NiTO_3$ formed probably cannot be reduced to Ni under liquefaction conditions and therefore is not available for catalysis of hydrogenation reactions. This has been supported by preliminary oxygen chemisorption experiments which show that the 700° C./air treatment produces a catalyst that has less than half the active nickel of the other materials.

EXAMPLE 6

Two other hydrous oxide systems, based on zirconium and niobium, have been tested in the same loading ranges using the same preparation methods described above for the sodium titanates in Examples 1 and 2. The following table gives the results for these tests in terms of conversion of coal to low molecular weight (mw) product (oil) and hydrogen consumption. The results represent the average of duplicate experiments.

| Hydrous Metal Oxide System | Active Metal | Low mw Conversion (%) | Hydrogen Consumption (%) |
|---|---|---|---|
| Zirconium | Ni | 49.0 | 0.84 |
| Zirconium | Mo | 51.8 | 1.30 |
| Niobium | Ni | 49.7 | 0.98 |
| Niobium | Mo | 57.3 | 1.65 |

(Experimental Conditions - Nominal Reaction Temperature - 420° C.; Reaction Time - 30 min; 2:1 Solvent:Coal; Cold Charged Hydrogen Pressure - 800 psig; Active Metal Added - $1 \times 10^{-4}$ moles)

The results may be compared with the control experiments performed under the same conditions for no catalyst addition (low mw product =26.8%, hydrogen consumption=0.69%) and addition of Shell 324 M (Ni/Mo on alumina, $1\times10^{-4}$ total moles of active metal, low mw product=54.3%, hydrogen consumption=1.79%).

The preceding examples can be repeated with similar success by substituting the generically or specifically described reactants and/or operating conditions of this invention for those used in the preceding examples.

From the foregoing descriptions, one skilled in the art can easily ascertain the essential characteristics of this invention, and without departing from the spirit and scope thereof, can make various changes and modifications of the invention to adapt it to various usages and conditions.

What is claimed is:

1. In a hydrogenation process catalyzed by an active metal on a carrier, wherein sdid metal is a catalyst for the process, the improvement wherein the carrier is an amorphous hydrous, alkali metal or alkaline earth metal titanate, zirconate, niobate, or tantalate, in which the alkali or alkaline earth metal cations have been exchanged with a catalytically effective quantity of said catalyst metal.

2. In the process of claim 1 which is for hydrotreating a hydrocarbon with a catalyst, the improvement comprising, contacting the hydrocarbon with hydrogen and a catalyst comprising a hydrous, alkali metal or alkaline earth metal titanate, zirconate, niobate or tantalate wherein alkali or alkaline earth metal cations have been exchanged with catalytically effective amount of a metal cation which is catalytically active in the hydrotreatment of the hydrocarbon.

3. The process of claim 2 wherein the hydrocarbon is a tar heavy oil or coal.

4. The process of claim 3 comprising liquefying coal.

5. The process of claim 1 wherein the catalyst comprises a hydrous titanate.

6. The process of claim 2 wherein the catalyst comprises a hydrous titanate.

7. The process of claim 1 wherein the catalyst comprises a hydrous zirconate or niobate.

8. The process of claim 1 wherein all of the alkali or alkaline earth metal bar been exchanged with active metal and the amount of the latter is up to 20 wt. % of the catalyst.

9. The process of claim 3 wherein all of the alkali or alkaline earth metal has been exchanged with active metal and the amount of the latter is up to 20 wt. % of the catalyst.

10. The process of claim 1 wherein the pore volume of the catalyst is about 0.2–0.4 cc/g and the specific surface area is about 150–300 $m^2/g$.

11. The process of claim 2 wherein the active metal is Rh, Ni, Co, Mo, Pd, Ru or Co/Mo.

12. The process of claim 5 wherein the active metal is Rh, Ni, Co, Mo, Ru, or Co/Mo.

* * * * *